US007866473B2

(12) United States Patent
Clark, Jr. et al.

(10) Patent No.: US 7,866,473 B2
(45) Date of Patent: Jan. 11, 2011

(54) FLEXIBLE PACKAGE HAVING AN EASY OPENING FEATURE

(75) Inventors: James Joseph Clark, Jr., Appleton, WI (US); Kim Ann Hanson, Appleton, WI (US); Sheila Marie Heyrman, Appleton, WI (US); Jacqueline Marie Maxton, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1871 days.

(21) Appl. No.: 10/901,884

(22) Filed: Jul. 29, 2004

(65) Prior Publication Data

US 2006/0021894 A1 Feb. 2, 2006

(51) Int. Cl.
*B65D 33/00* (2006.01)
*B65D 85/00* (2006.01)
*B65D 75/58* (2006.01)

(52) U.S. Cl. ..... 206/494; 206/440; 383/207

(58) Field of Classification Search ..... 206/440, 206/494, 554, 497; 383/207, 124, 7, 208, 383/209, 5, 205, 200; 493/926
See application file for complete search history.

(56) References Cited

U.S. PATENT DOCUMENTS

| | | | | |
|---|---|---|---|---|
| 3,227,359 | A | 1/1966 | Hanlon | |
| 3,497,130 | A * | 2/1970 | Stahl | 383/10 |
| 4,890,934 | A | 1/1990 | Feaver et al. | |
| 4,934,535 | A | 6/1990 | Muckenfuhs et al. | |
| 4,966,286 | A | 10/1990 | Muckenfuhs | |
| 5,022,216 | A | 6/1991 | Muckenfuhs et al. | |
| 5,036,978 | A | 8/1991 | Frank et al. | |
| 5,282,687 | A | 2/1994 | Yee | |
| 5,514,067 | A | 5/1996 | Schmidt et al. | |
| 5,666,445 | A | 9/1997 | Conrad et al. | |
| 5,722,773 | A | 3/1998 | Conrad | |
| 5,816,992 | A | 10/1998 | Conrad | |
| 5,934,470 | A | 8/1999 | Bauer et al. | |
| 6,095,686 | A | 8/2000 | Mohrmann | |

(Continued)

FOREIGN PATENT DOCUMENTS

| | | |
|---|---|---|
| DE | 42 24 639 A1 | 1/1994 |

(Continued)

*Primary Examiner*—Mickey Yu
*Assistant Examiner*—Steven A. Reynolds
(74) *Attorney, Agent, or Firm*—David J. Arteman; Bryan R. Rosiejka

(57) ABSTRACT

A flexible package is disclosed having an easy opening feature. The opening feature includes a gusset formed in at least one side wall. The gusset is aligned inward of the side wall and forms a pocket having an internal panel and an external panel. An aperture is formed through the external panel and is sized to receive at least one human finger. The package also has a line of weakness formed in the side wall containing the external panel with the aperture formed therethrough. The line of weakness has two portions, each located on an opposite side of the aperture and each extending from the first end of the gusset to a point spaced apart therefrom. The line of weakness also has a third portion which extends across the side wall and connects with the first two portions of the line of weakness. The combination of the gusset, the aperture and the line of weakness create a structure which allows the package to be easily opened.

13 Claims, 7 Drawing Sheets

U.S. PATENT DOCUMENTS

| | | | | |
|---|---|---|---|---|
| 6,698,928 | B2 * | 3/2004 | Miller | 383/205 |
| 2003/0180492 | A1 * | 9/2003 | Bobbe et al. | 428/40.1 |

FOREIGN PATENT DOCUMENTS

| | | | |
|---|---|---|---|
| EP | 0 471 274 | B1 | 6/1995 |
| EP | 0 504 317 | B1 | 9/1995 |
| EP | 0 656 772 | B1 | 6/1998 |
| EP | 0 720 574 | B1 | 6/1998 |
| EP | 0 650 713 | B1 | 9/1999 |
| GB | 1 282 739 | A | 7/1972 |

* cited by examiner

FLEXIBLE PACKAGE HAVING AN EASY OPENING FEATURE

BACKGROUND OF THE INVENTION

It has been realized that cost savings can be obtained by compressing disposable absorbent articles within a flexible package. The flexible packages are normally formed from a polymeric material, such as polyethylene, polypropylene or a blend thereof. A compressed package produces a smaller volume package which reduces distribution expenses. Besides the distribution cost savings, a majority of the material from which an individual package is constructed is held in tension thereby creating a nice smooth appearance across the front surface of the package. This smooth appearance makes it easier for the consumer to view the graphics and read the writing on the package. In addition, a compressed package produces a smaller size package which is easier for the consumer to handle. However, current compressed packages have a couple of drawbacks. One is that the opening feature may not be readily apparent and therefore the consumer may not be able to find the opening. Second, since the articles contained within the compressed package are slightly compressed themselves, it may be difficult for the consumer to easily remove the first few products from the package.

Therefore, there is a need to create a compressed package with an easy opening feature which will enhance the overall consumer experience. By producing a compressed package that has an opening feature that is easy to locate, easy to open and one that will allow the articles to be accessed one at a time, a more user friendly compressed package can be produced.

SUMMARY OF THE INVENTION

Briefly, this invention relates to a flexible package having an easy opening feature. The package includes a front wall, a back wall, a pair of opposing side walls, a top wall and a bottom wall. All of the walls are connected together to form an internal compartment having a height, a width and a depth. The compartment is capable of containing a multiplicity of articles. The package also has a gusset formed in at least a portion of one of the pair of opposing side walls. The gusset has a first end aligned with the top wall and a second end extending downward toward the bottom wall. The gusset is aligned inward of a portion of one of the pair of opposing side walls to form a pocket having an internal panel and an external panel. The package also has an aperture formed through the external panel of the pocket and the aperture is sized to receive at least one human finger. Lastly, the package has a line of weakness formed in the side wall containing the external panel with the aperture formed therethrough. The line of weakness has two portions, each located on an opposite side of the aperture and each extending from the first end of the gusset to a point spaced apart therefrom. The line of weakness also has a third portion which extends across the side wall and connects with the first two portions of the line of weakness. The combination of the gusset, the aperture and the line of weakness creates a structure which allows the package to be easily opened.

DETAILED DESCRIPTION

Figure 1:
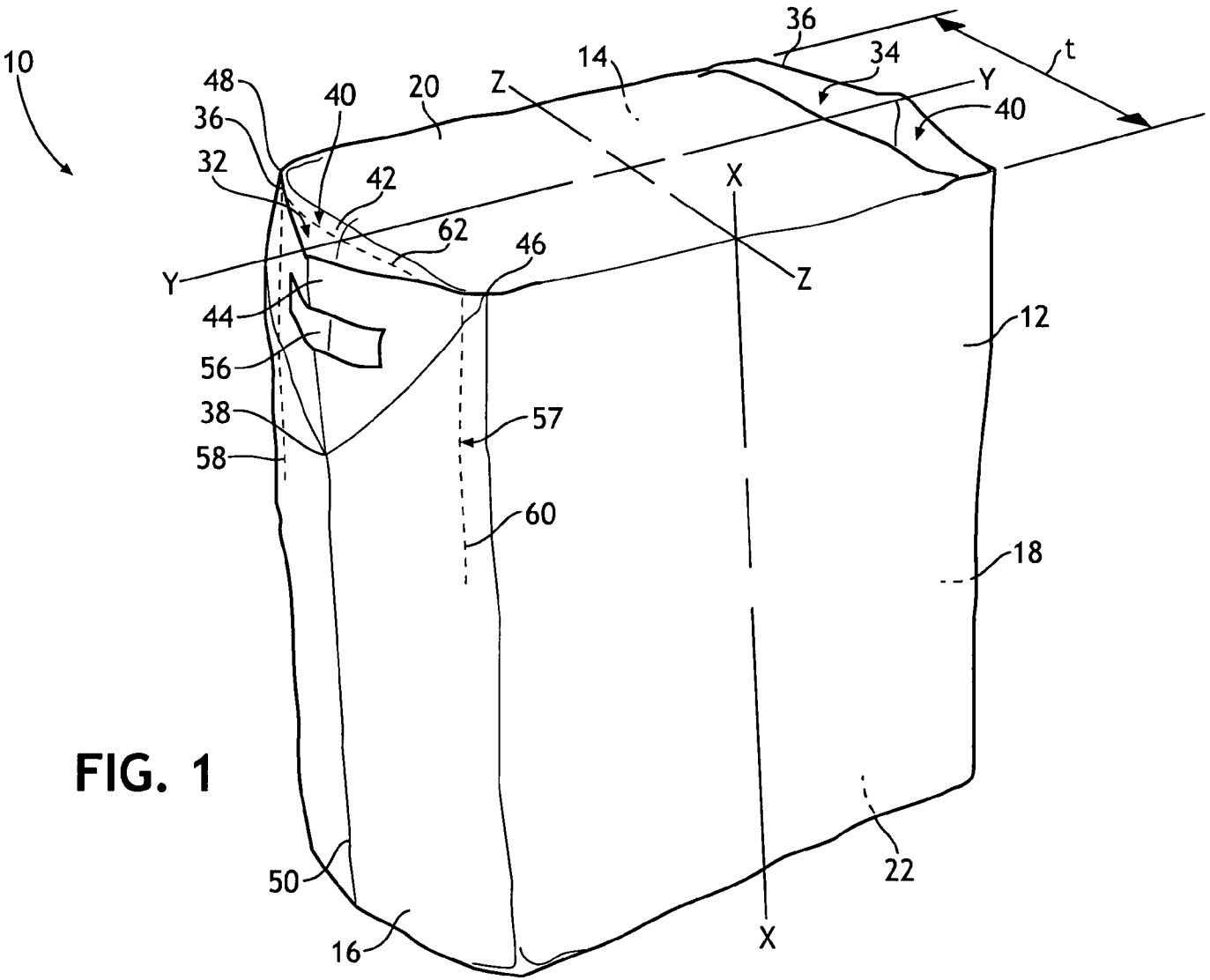
FIG. 1 is a perspective view of a flexible package having an easy opening feature.
Figure 2:
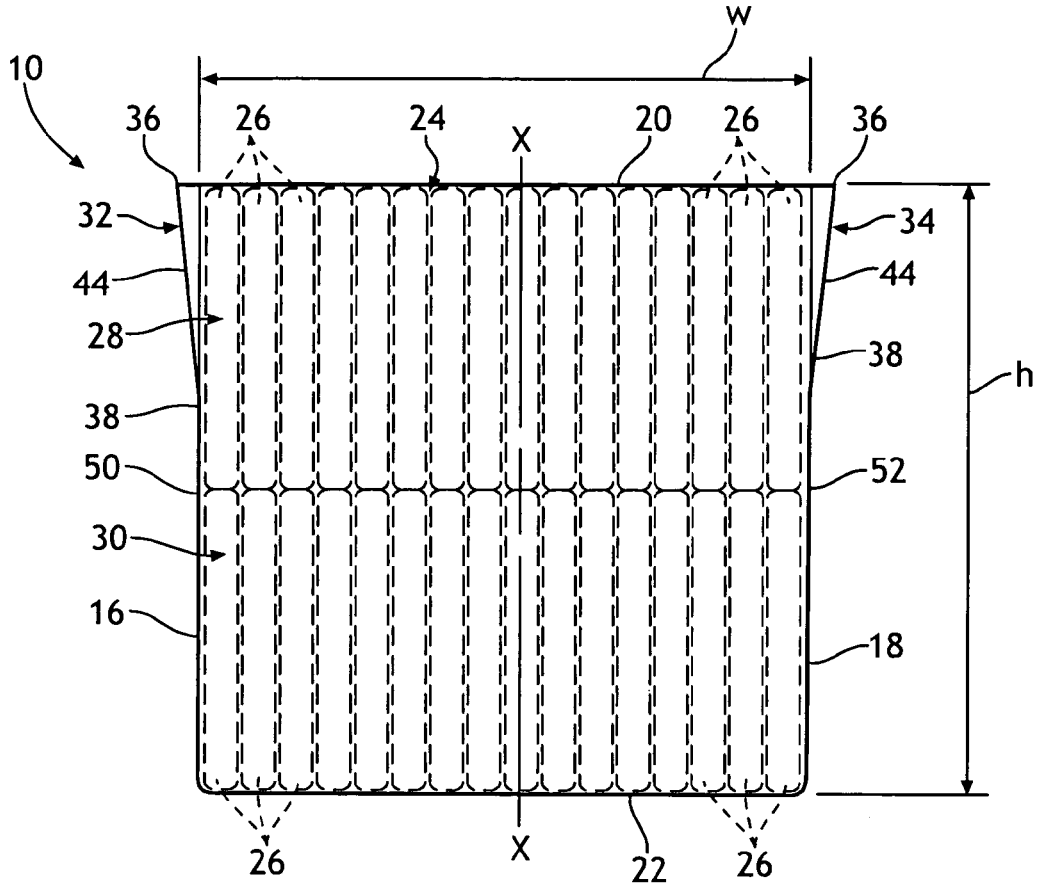
FIG. 2 is a plane front view of the flexible package shown in FIG. 1 depicting two horizontal rows of articles stacked within the package.

Referring to FIGS. 1 and 2, a flexible package 10 is shown having an easy opening feature. The package 10 includes a multiplicity of walls. For example, the package 10 can have a front wall 12, a back wall 14, a pair of opposing side walls 16 and 18, a top wall 20 and a bottom wall 22. The package 10 has a longitudinal axis X-X, a transverse axis Y-Y and a vertical axis Z-Z. The package 10 also has a height h, a width w and a thickness t. All of the walls 12, 14, 16, 18, 20 and 22 are connected together to form an internal compartment 24. The internal compartment 24 is capable of containing a plurality of articles 26. By "plurality" it is meant three or more articles. Desirably, the articles 26 are arranged in one or more rows. In FIG. 2, two horizontal rows of articles 28 and 30 are depicted with an upper row 28 being located above a lower row 30 within the package 10. The rows 28 and 30 could be arranged side by side, if desired. Likewise, the package 10 can contain two or more rows arranged along the lower portion of the package 10 and two or more rows located above the lower rows. For example, a package can contain two bottom rows and two vertical rows thereby forming an aggregate of four rows within the package. Another example would be a package containing two bottom rows and three vertical rows thereby forming an aggregate of six rows within the package.

Each row 28 and 30 can consist of a plurality of articles 26. In FIG. 2, each of the rows 28 and 30 contains 16 articles. However, it should be readily apparent that the number of articles 26 contained within a given row can vary. For disposable absorbent articles, either wrapped or unwrapped, the number of articles 26 enclosed within a single package 10 usually ranges from between about 3 to about 200. Desirably, there are from about 5 to about 100 disposable absorbent articles in a given row. More desirably, there are from about 10 to about 50 disposable absorbent articles in a given row. The number of articles 26 in each row 28 and 30 can be the same or can differ. The articles 26 themselves should be capable of being compressed. Desirably, each article 26 can be compressed by at least 10%, and desirably, by at least 20%. The articles 26 can be almost any kind of product but the present invention will be described using disposable absorbent articles 26. A disposable absorbent article is a product that is primarily designed and constructed to absorb human discharge, such as urine, menses and/or fecal matter. The disposable absorbent article is a product that is designed for a single use before it is discarded and is not intended to be laundered and reused. Examples of disposable absorbent articles 26 include infant diapers, training pants, sanitary napkins, feminine pantyliners and pads, tampons, adult incontinence garments, such as pads, briefs and undergarments, as well as other disposable absorbent products.

The flexible package 10 can be formed from a polymeric material, such as polyethylene, polypropylene or a blend thereof. One material that works well is a polymeric film. Polymeric films used to produce the flexible package 10 should have a thickness of less than about 5 mils, desirably, less than about 3 mils, and more desirably, less than about 1.5 mils. A "mil" is equal to one-thousandth of an inch. Other natural and synthetic materials, known to those skilled in the art, could also be used to form the package 10. Such other materials include, but are not limited to, woven and non-woven materials.

The flexible package 10 is filled with a plurality of articles 26. The articles 26 can be randomly or uniformly arranged within the package 10. Desirably, the articles 26 are arranged in at least one row 28 which extends from one side wall 16 to the other side wall 18. Normally, the articles 26 are first compressed and are then inserted into the package 10. Once the articles 26 are retained in the package 10, the package 10 is sealed. The compressed articles 26 will try to expand once they are within the sealed package 10 and this action places the opposing side walls 16 and 18 of the package 10 under tension and creates a smooth front wall 12. This smooth front wall 12 makes it easy for a consumer to view the graphics and read the words printed on the package 10. This side-to-side compression also facilitates easy removal of the articles 26 from the package 10 because of the location of the tearable opening, which will be explained shortly.

Figure 3:
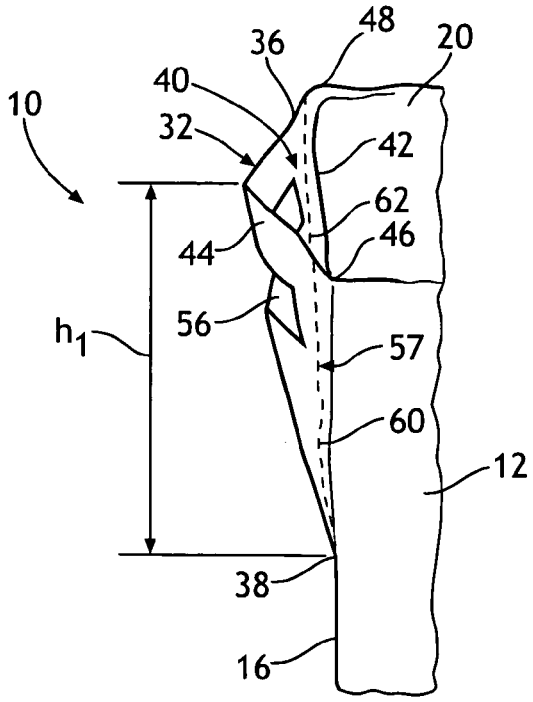
FIG. 3 is a perspective view of the upper left portion of the package shown in FIG. 1.

Referring now to FIGS. 1-3, the flexible package 10 is constructed with at least one gusset 32, and desirably, with a pair of gussets 32 and 34. By a "gusset" it is meant a member, for example a triangular member, capable of strengthening and/or enlarging the flexible package 10. The gusset 32 can be a separate piece of material or can be an extension of or integrally formed from the material from which the flexible package 10 is constructed. The gusset 32 can be viewed as a pocket, receptacle, cavity or opening. The one or two gussets, 32 or 32 and 34, are located in the top of the package 10 and are exposed to make them visible to the ultimate consumer. When two gussets 32 and 34 are present, they can be located on the opposite sides of the top wall 20, on opposite sides of the bottom wall 22 or one in the top wall 20 and one in the bottom wall 22 so as to provide a natural location where the consumer can easily grasp the package 10. The first gusset 32 is formed in at least a portion of the side wall 16 and the second gusset 34 is formed in at least a portion of the side wall 18. Each of the gussets 32 and 34 is shown as having a triangular configuration, although variations of the triangular shape can be employed. The actual configuration of the gussets 32 and 34 can be formed by folding the material from which the package 10 is constructed. Each of the gussets 32 and 34 has a first end 36 that can be aligned with the top wall 20 or can be slightly offset therefrom. Each of the gussets 32 and 34 has a second end 38 which is spaced away from the first end 36 and extends downward toward the bottom wall 22. The first end 36 represents the base of the triangular configuration of each of the gussets 32 and 34 and the second end 38 represents the apex of the triangular configuration. Each of the gussets 32 and 34 has a height $h_1$ that extends at least about 20% of the package height h, see FIG. 3. Desirably, each of the gussets 32 and 34 has a height $h_1$ that extends at least about 30% of said package height h. More desirably, each of the gussets 32 and 34 has a height $h_1$ that extends from between about 20% to about 90% of the package height h. The height $h_1$ of the gusset 32 or 34 can vary depending upon the thickness of the package 10. For example, as the thickness of a package 10 increases, the height $h_1$ of the gusset 32 or 34 will generally get bigger.

Each of the gussets 32 and 34 is aligned inward of a portion of one of the pair of opposing side walls 16 and 18 to form a pocket 40. Each pocket 40 has an internal panel 42 and an external panel 44. Each pocket 40 is formed by folding the material forming the package 10 such that the internal and external panels, 42 and 44 respectively, are joined together and extend diagonally downward from the opposite upper corners of the package 10 down to the second end 38. In FIG. 3, the front wall 12, the top wall 20 and the side wall 16 form a front upper corner 46 while the back wall 14, the top wall 20 and the side wall 16 form a back upper corner 48 (see FIG. 1). The internal and external panels, 42 and 44 respectively, are each joined at the corners 46 and 48 and have a common line of intersection that diverges diagonally downward and inward toward the second end 38. The function of the gussets 32 and 34 is to strengthen the upper region of the side walls 16 and 18 and to provide an enlarged area whereby the consumer can position one, two or more of his or her fingers so as to easily open the package 10.

Figure 4:
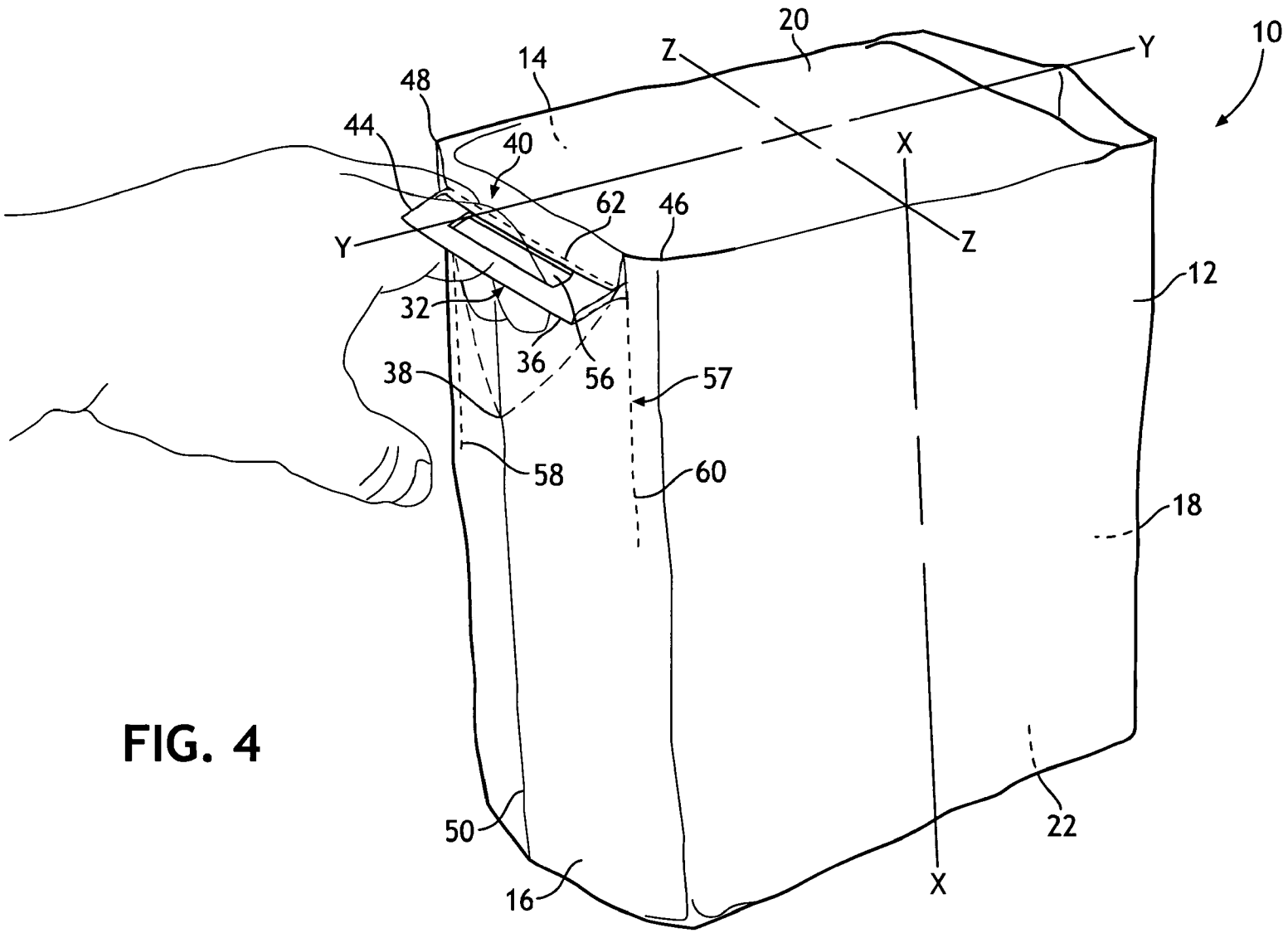
FIG. 4 is a perspective view of the flexible package shown in FIG. 1 depicting a person inserting two fingers into the aperture formed in the external panel of the pocket and pulling down on the gusset to open the package.
Figure 5:
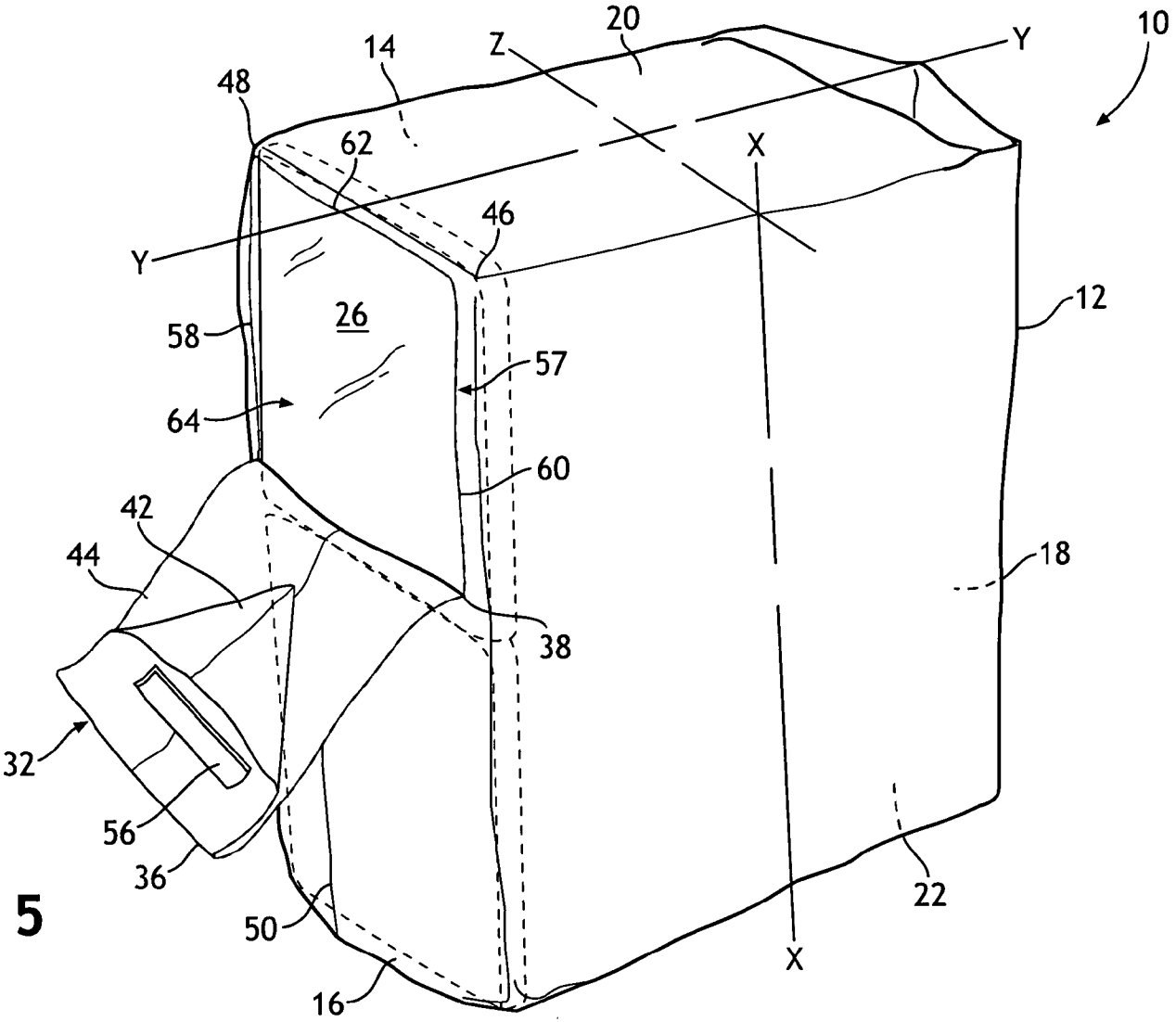
FIG. 5 is a perspective view of the flexible package shown in FIG. 1 depicting the side wall being separated by breaking the three portions of the line of weakness to create a sufficiently large opening which allows the articles housed in the package to be removed.
Figure 6:
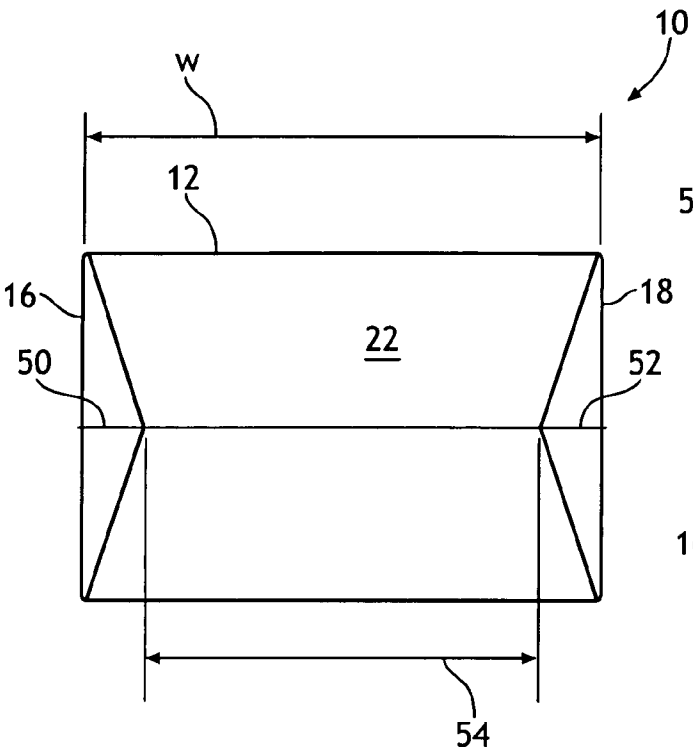
FIG. 6 is a bottom view of the flexible package shown in FIG. 1 depicting the bottom seal.

Referring now to FIGS. 1 and 3-6, the flexible package 10 also includes a pair of seals 50 and 52, each formed in the opposing side walls 16 and 18. The pair of seals 50 and 52 can be formed by a heat and pressure bond, by a thermal bond, by an ultrasonic bond, by adhesive or by another means known to those skilled in the art. The pair of seals 50 and 52 is present in the external panels 44 of the pockets 40 and each spans the entire height h of the package 10. Each of the pair of seals 50 and 52 extends from the first end 36 of one of the gussets 32 and 34 downward into the bottom wall 22. The pair of seals 50 and 52 can be aligned parallel to the central longitudinal axis of the side wall 16, if desired. In FIG. 6, one can see that the pair of seals 50 and 52 actually extends into and across a portion of the bottom wall 22. The distance that each of the pair of seals 50 and 52 extends across a portion of the bottom wall 22 can vary. Desirably, the pair of seals 50 and 52 will extend across at least about 10% of the width w of the bottom wall 22. The purpose of the pair of seals 50 and 52 is to secure the pair of side walls 16 and 18 together whereby the front wall 12, the back wall 14, the pair of side walls 16 and 18, and the top wall 20 create the internal compartment 24 which is open only at the bottom wall 22. The package 10 is designed to have the multiplicity of articles 26 inserted into it via the open bottom wall 22. After the articles 26 are positioned within the package 10, the bottom wall 22 will then be sealed.

Referring to FIG. 6, a bottom seal 54 is formed in the bottom wall 22 after a plurality of articles 26 are placed into the internal compartment 24 of the package 10. Desirably, the articles 26 are compressed before being positioned within the internal compartment 24. Once the articles 26 are positioned with the package 10, the bottom wall 22 is sealed by any of the bonds described above with reference to the pair of seals 50 and 52. A heat and pressure bond works well for a polymeric film material. The bottom seal 54 cooperates with said pair of seals 50 and 52 to completely enclose the articles 26 within the package 10. By "completely enclose" it is meant that the plurality of articles 26 are surrounded on all sides by the material forming the package 10. The bottom seal 54 can be aligned parallel to the central transverse axis of the package 10, if desired.

Referring again to FIGS. 1 and 3-5, an aperture 56 is formed through the external panel 44 of at least one of the pockets 40. The aperture 56 should be formed close to the first end 36 of the gusset 32 to facilitate the insertion of a person's fingers. The aperture 56 is shaped and sized to receive at least one human finger. Desirably, two, three or four fingers of a person's hand can be positioned in the upper end of one of the pockets 40. By locating the pockets 40 in the upper portion of the package 10, it is easy for the consumer to locate the opening mechanism. In FIG. 4, the middle and index fingers of a person's left hand are shown being inserted down into the pocket 40 from above such that the finger tips extend out through the aperture 56. The fingers can extend through the aperture 56 up to approximately the first knuckle.

It should be noted that an area of weakness can be substituted for each aperture 56. For example, it is known to those skilled in the art that a material can be treated, coated, printed on, etc. such that a section or area of the material having a predetermined shape and size can be made weaker. When a person contacts such an area with his or her finger tip, the material will stretch, elongate or extend outward to form a finger tip pocket without actually breaking or tearing the material. In essence, the finger tip pocket will function as the aperture 56. For the purpose of this invention, by an "aperture" it is meant a hole, gap, slit, orifice, or other opening, or a finger tip pocket, cavity, depression, or other indentation where the material is not separated but can be deformed to a configuration allowing one or more of a person's finger tips to engage therewith.

Figure 7:
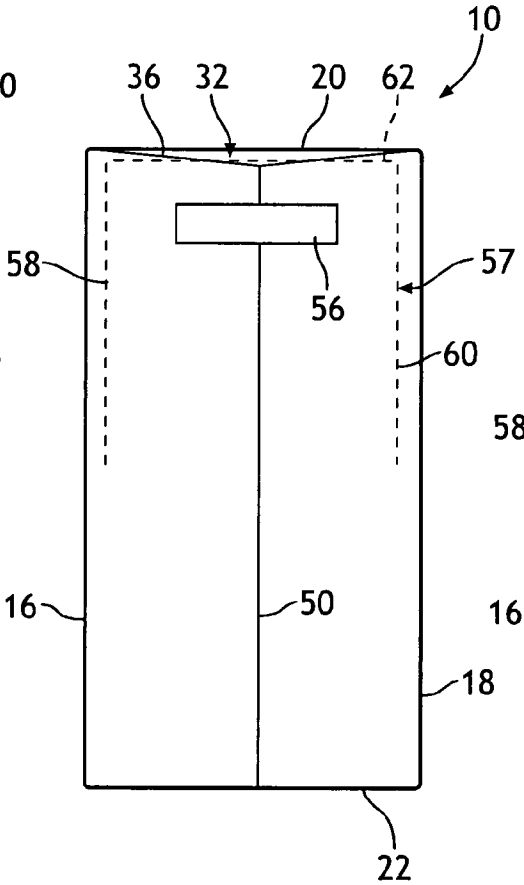
FIG. 7 is a side view of the flexible package shown in FIG. 1 depicting a rectangular shaped aperture and the three portions of the line of weakness.

Referring to FIG. 7, the opening mechanism of the flexible package 10 further includes a line of weakness 57 having a first portion 58, a second portion 60 and a third portion 62. Additional portions, such as a fourth portion, can be added to the line of weakness 57, if desired. The three portions 58, 60 and 62 of each line of weakness 57 is formed in at least one of the side walls 16 or 18, which also contains the external panel 44 with the aperture 56 formed therethrough. Each of the three portions 58, 60 and 62 can be a continuous, discontinuous or intermittent line or a combination thereof. The three portions 58, 60 and 62 do not have to be of similar length. One can also view the three portions 58, 60 and 62 as being three separate lines of weakness connected together to form a single line of weakness 57. Each of the three portions 58, 60 and 62 do not have to physically touch or intersect with another portion but can be spaced apart from at least one of the other portions. Each of the three portions 58, 60 and 62 can be a linear line or a non-linear line. Examples of non-linear lines for the three portions 58, 60 and 62 can include a curved line, an S-shaped line, a zigzag line, or an arcuate line.

Each of the three portions 58, 60 and 62 can be a perforated line, a line formed by a plurality of openings, such as slots separated by a plurality of land areas, a line of reduced material thickness, a weakened line formed by joining two sections of material together, or be any other structural configuration known to those skilled in the art. The three portions 58, 60 and 62 can be formed in one of the side walls 16 or 18 or all three portions 58, 60 and 62 can be formed in both of the side walls 16 and 18. When the three portions 58, 60 and 62 are formed in both of the side walls 16 and 18, the package 10 can be easily opened from either side. This feature may prove to be beneficial to both right and left handed consumers. However, the three portions 58, 60 and 62 only have to be formed in one of the side walls 16 or 18 in order to provide easy and convenient access to the articles 26 enclosed in the package 10.

In FIG. 7, each of the first two lines of weakness 58 and 60 are located on an opposite side of the aperture 56. The first two portions 58 and 60 are depicted in FIGS. 1 and 4-5 as being aligned approximately parallel to one another and parallel to the longitudinal centerline X-X of the package 10. The first two portions 58 and 60 do not have to be parallel to one another but can be non-parallel to one another or be arranged as a mirror image of one another. In addition, each of the first two portions 58 and 60 can be totally different in shape and design from the other one, if desired. Each of the first two portions 58 and 60 can extend from the first end 36 of the gusset 32 downward to a point spaced apart from the bottom wall 22. The length of each of the first two portions 58 and 60 should be approximately the same, although this is not a requirement, and each of the first two portions 58 and 60 can extend from about 20% to about 100% of the height h of the package 10. Desirably, each of the first two portions 58 and 60 will extend from about 25% to about 90% of the height h of the package 10. More desirably, each of the first two portions 58 and 60 will extend from about 30% to about 75% of the height h of the package 10. The length of the first two portions 58 and 60 will be partly dictated by the number of rows 26 and 28 of articles 26 enclosed within the package 10. It is important to note that each of the first two portions 58 and 60 begin at the first end 36 of the gusset 32 which is located above the aperture 56. This structure helps assure that as the consumer pulls the aperture 56 downward and outward, that the first two portions 58 and 60 will easily start to break.

In order to open the package 10, the consumer can place one of his or her hands gently but firmly on the top wall 20 of the package 10 and pull the gusset 32 downward and outward with the other hand. Such action will cause the first two portions 58 and 60 of the line of weakness 57 to start to tear or break. The first two portions 58 and 60 are designed to begin breaking before the third portion 62 will start to break. The first two portions 58 and 60 will not be completely broken when the third portion 62 starts to break. It should be noted that the third portion 62 is intended to be completely broken before the first two portions 58 and 60 are completely broken.

It should be noted that a package 10 having at least one line of weakness 57 can be manufactured such that the first two portions 58 and 60 will not break under ordinary handling of the package 10. Instead, the first two portions 58 and 60 can be made to break only when a predetermined amount of force is placed on the gusset 32 and the gusset 32 is pulled downward and outward. The amount of force needed to break the first two portions 58 and 60 can be adjusted in a number of ways. For example, the amount of force can be varied by changing the thickness of the material from which the package 10 is constructed, by using a stronger material for the package 10, by changing the method of forming the first two portions 58 and 60, or by changing the location of the first two portions 58 and 60. Other means for changing the amount of force needed to break the first two portions 58 and 60 of the line of weakness 57 will be known to those skilled in the art. When the first two portions 58 and 60 are two perforation lines, one can vary the amount of force needed to break the perforation lines by lengthening the land areas between the slots.

Figure 8:
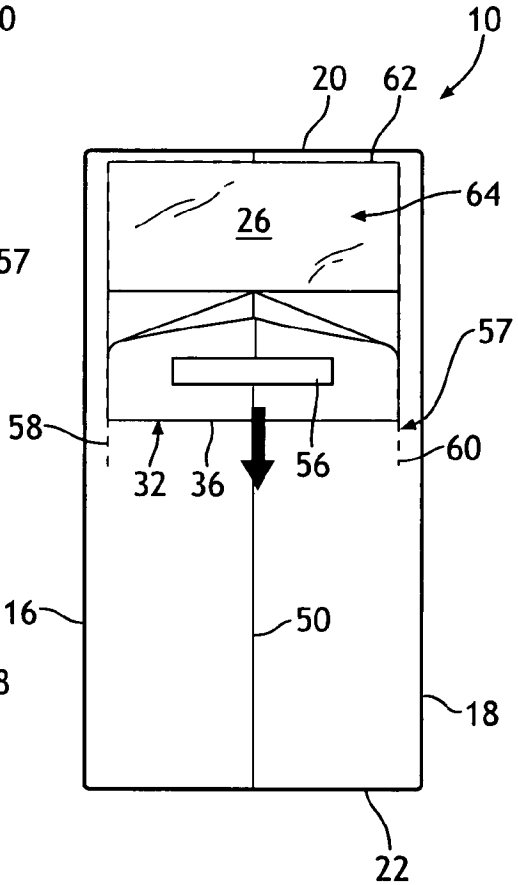
FIG. 8 is a side view of the flexible package shown in FIG. 7 depicting the three portions of the line of weakness being broken as the side wall is pulled downward away from the top wall.

Referring to FIGS. 7 and 8, the third portion 62 of the line of weakness 57 extends across at least a portion of the side wall 16 and connects with the first two portions 58 and 60. The third portion 62 can be aligned perpendicular to the first two portions 58 and 60, as shown, or be aligned at an angle to the first two portions 58 and 60. Expressed another way, the third portion 62 connects with the first two portions 58 and 60 to form a continuous path of weakness that can be broken as the consumer pulls downward and outward on the aperture 56.

Referring now to FIG. 8, the package 10 is shown with the gusset 32 being torn open. In this embodiment, the first two portions 58 and 60 of the line of weakness 57 are partially broken and the third portion 62 has been completely broken. Since the third portion 62 extends transversely across the side wall 16, it is designed to be completely broken after the first two portions 58 and 60 begin to break. In FIG. 8, one can see that an opening 64 is created into the internal compartment 24 of the package 10 as the three portions 58, 60 and 62 began to break. The outermost article 26 is visible as the opening 64 becomes larger. The opening feature of the flexible package 10 is made up of one of the gussets 32 or 34, the aperture 56 and the line of weakness 57 to create a structure which allows the package 10 to be easily opened.

It should be noted that the flexible package 10 does not have a handle but instead is void of a handle. If one desired to secure a handle onto the package 10, one could easily do so. Several different ways of attaching or securing a permanent or removable handle to the flexible package 10 are known to those skilled in the art. Since compressed packages tend to be smaller in overall volume, having a smaller width dimension, the need for a handle is not as prevalent as for larger size packages.

Figure 9:
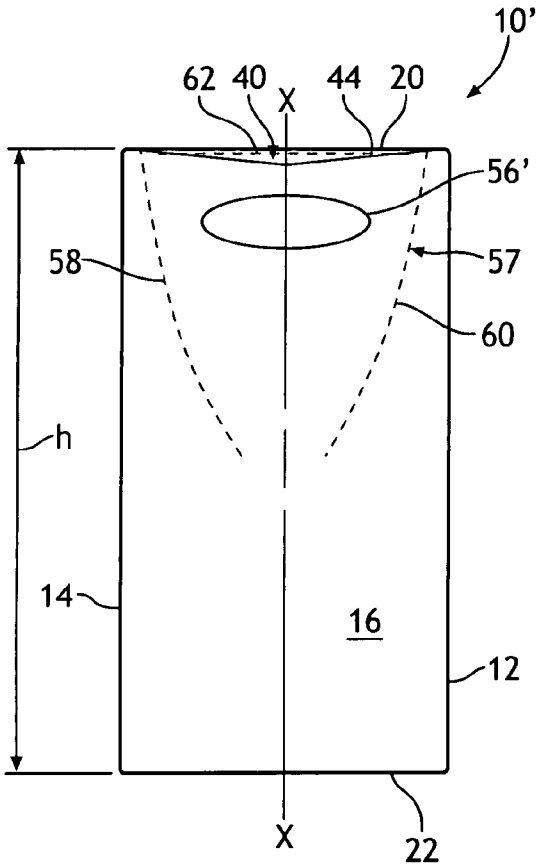
FIG. 9 is an alternative embodiment of a side view of a flexible package showing an oval shaped aperture and with two portions of the line of weakness converging towards one another as they approach the bottom wall.

Referring now to FIGS. 9-14, six different embodiments are shown for forming and constructing the aperture(s) and the line of weakness 57. In FIG. 9, a flexible package 10' is shown having an oval or elliptically shaped aperture 56' formed in the external panel 44 of the pocket 40. In addition, the first two portions 58 and 60 of the line of weakness 57 are shown as being non-linear and curving or converging towards one another as they approach the bottom wall 22. Furthermore, the first two portions 58 and 60 extend over 50% of the height h of the package 10'.

Figure 10:
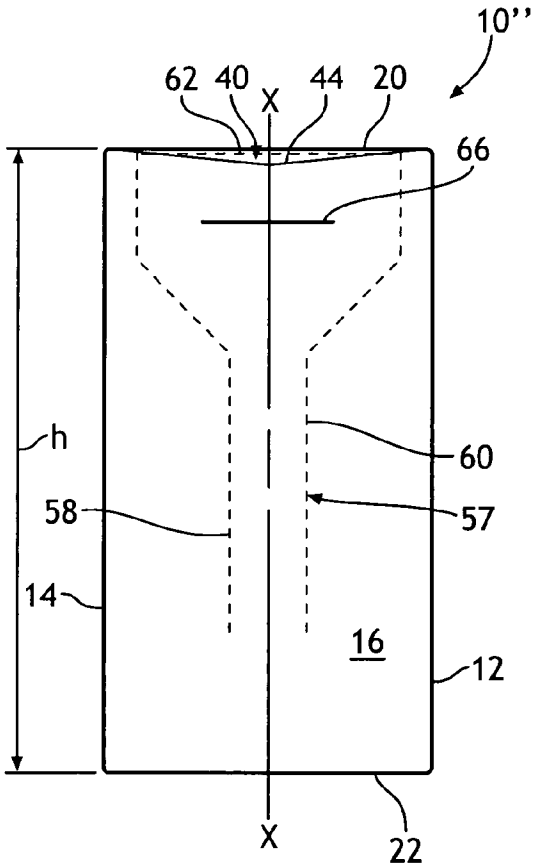
FIG. 10 is an alternative embodiment of a side view of a flexible package showing the aperture being in the form of a slit and with two portions of the line of weakness having a non-linear configuration.

In FIG. 10, a flexible package 10" is shown having a single horizontal slit 66 in place of the aperture 56 that is formed in the external panel 44 of the pocket 40. The slit 66 can be expanded as one pokes one or more finger tips through the slit 66 thereby creating an aperture. One will also notice that the first two portions 58 and 60 are non-linear lines having an overall funnel shape that narrows as the first two portions 58 and 60 each approach the bottom wall 22. Furthermore, the first two portions 58 and 60 of the line of weakness 57 extend over 70% of the height h of the package 10".

Figure 11:
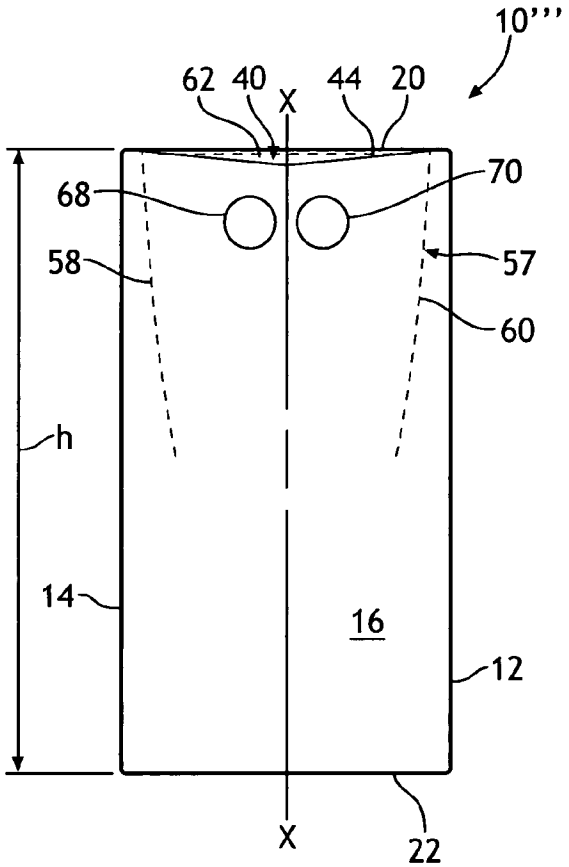
FIG. 11 is an alternative embodiment of a side view of a flexible package showing the aperture as two circular openings and with two portions of the line of weakness diverging towards one another as they approach the bottom wall.

In FIG. 11, a flexible package 10''' is shown having two identical circular apertures 68 and 70 formed in the external panel 44 of the pocket 40. The two apertures 68 and 70 can be arranged side by side with each being located on one side of the central longitudinal axis of the side wall 16. Each of the circular apertures 68 and 70 should be sized to allow a person to insert a finger therethrough. In addition, the first two portions 58 and 60 are depicted as linear lines angling toward one another as they approach the bottom wall 22. Furthermore, the first two portions 58 and 60 of the line of weakness 57 extend over 60% of the height h of the package 10'''.

Figure 12:
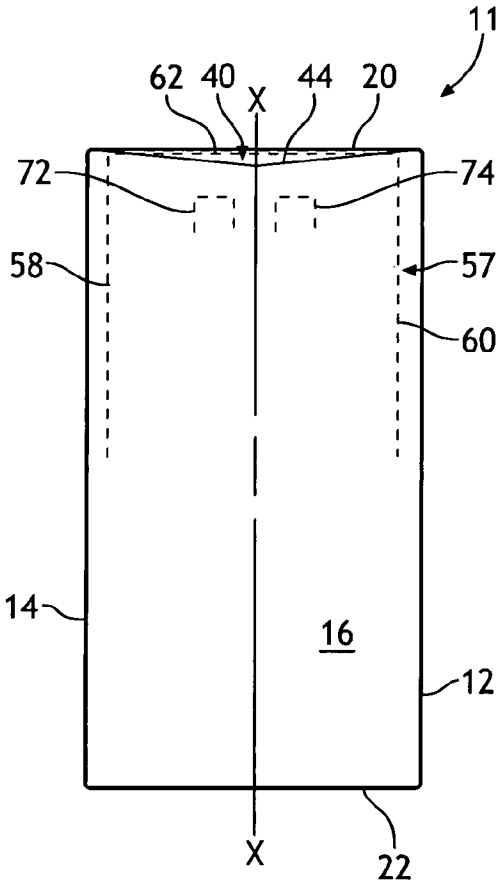
FIG. 12 is an alternative embodiment of a side view of a flexible package showing the aperture in the form of two perforated tabs that can be broken as a pair of finger tips push against them from the inside of the pocket and with two portions of the line of weakness being aligned parallel to one another.

In FIG. 12, a flexible package 11 is shown having two U-shaped perforation tabs 72 and 74 with each being located on one side of the central longitudinal axis of the side wall 16. The U-shaped perforation tabs 72 and 74 can be square, rectangular or of some other desired shape. Each of the two perforation tabs 72 and 74 should be sized to allow a person to insert a finger therethrough once the perforations 72 and 74 are broken. In addition, the first two portions 58 and 60 of the line of weakness 57 are depicted as linear lines arranged parallel to one another and perpendicular to the third portion 62. Furthermore, the first two portions 58 and 60 of the line of weakness 57 extend over 60% of the height h of the package 11.

Figure 13:
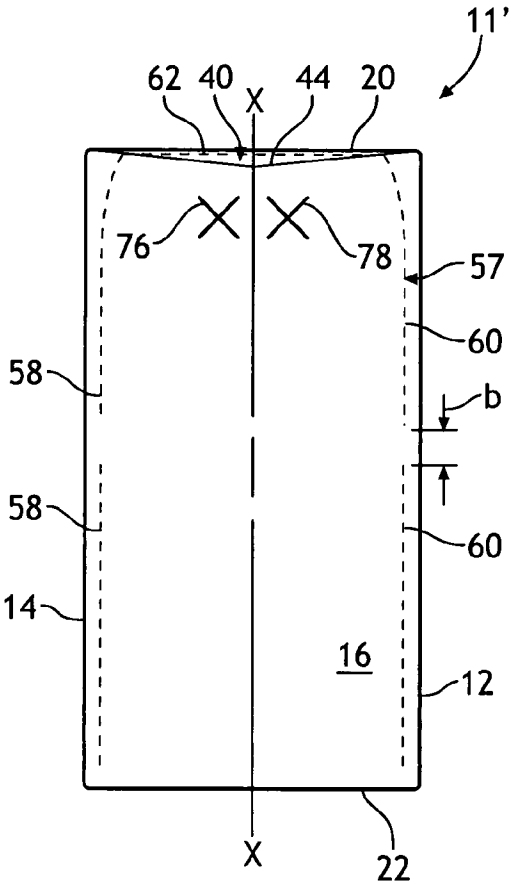
FIG. 13 is an alternative embodiment of a side view of a flexible package showing the aperture in the form of two X shaped slits that will open up as a pair of finger tips push against them from the inside of the pocket and with two portions of the line of weakness extending the length of the side wall and being aligned parallel to one another but are not continuous.

In FIG. 13, a flexible package 11' is shown having two X shaped slits 76 and 78 with each being located on one side of the central longitudinal axis of the side wall 16. Each of the two X shaped slits 76 and 78 should be sized to allow a person to insert a finger therethrough. In addition, the first two portions 58 and 60 are depicted as non-linear lines curved towards one another adjacent to the top wall 20 and then becoming parallel to one another as they approach the bottom wall 22. Furthermore, the first two portions 58 and 60 extend approximately 100% of the height h of the package 11'. The first two portions 58 and 60 of the line of weakness 57 also have a break (b) located along their length, approximately half way up the height h of the package 11", so as to make the first two portions 58 and 60 discontinuous. This arrangement can be advantageous when the package 11' contains two horizontal rows of articles 26. In this case, the consumer can tear or break the first two portions 58 and 60 up to the break (b) such that the articles 26 in the upper horizontal row can be easily removed. Once these articles 26 have been removed and used, the consumer can then pull down on the gusset 32 and tear the material bridging the break (b) that forms the package 11' until the remaining portions of the first two portions 58 and 60 are encountered. At this point, pulling down on the gusset 32 will cause the first two portions 58 and 60 to break or tear down to the bottom wall 22 exposing the second or lower row of articles.

It should also be recognized that three or more horizontal rows of articles 26 can be vertically arranged within a package. In this case, it is possible to form two or more breaks (b) along each of the first two portions 58 and 60 of the line of weakness 57. Within each of the first two portions 58 or 60, a break (b) will be spaced apart and separated from an adjacent break (b) by a segment of the first two portions 58 or 60. Desirably, each break (b) will be formed at a location aligned with an area representing the separation between every two vertically arranged rows of articles 26.

Figure 14:
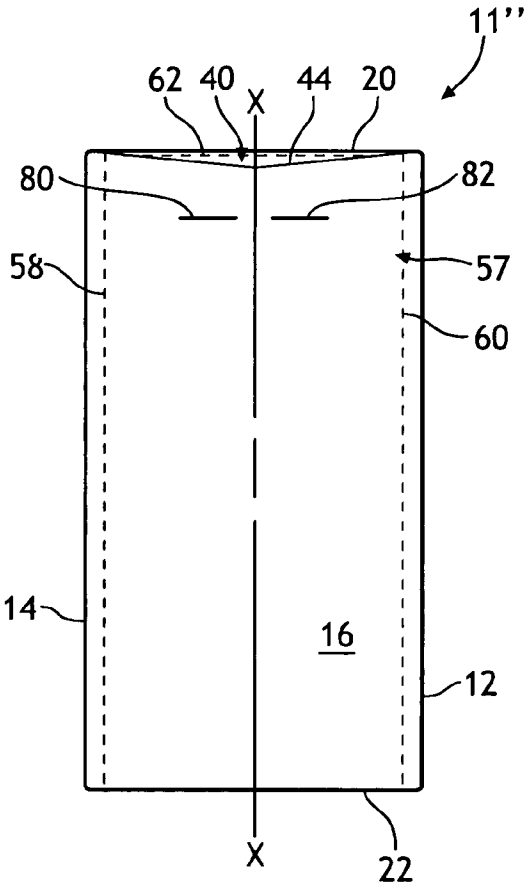
FIG. 14 is an alternative embodiment of a side view of a flexible package showing the aperture in the form of two horizontal slits that will open up as a pair of finger tips push against them from the inside of the pocket and with two portions of the line of weakness being continuous and each extending the length of the side wall and being aligned parallel to one another.

Lastly, in FIG. 14, a flexible package 11" is shown having two horizontal slits 80 and 82 with each being located on one side of the central longitudinal axis of the side wall 16. Each of the two horizontal slits 80 and 82 should be sized to allow a person to insert a finger therethrough. In addition, the first two lines of weakness 58 and 60 are depicted as continuous, linear lines. The first two portions 58 and 60 are arranged parallel to one another and perpendicular to the third line of weakness 62. Furthermore, the first two portions 58 and 60 of the line of weakness 57 extend approximately 100% of the height h of the package 11".

It should be noted that other geometrical shapes for the aperture 56 and other arrangements for the line of weakness 57 are possible.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

We claim:

1. A flexible package having an easy opening feature, said package comprising:

a) a plurality of walls being connected together to form an internal compartment capable of containing a multiplicity of articles, said plurality of walls including a pair of opposing side walls;

b) a gusset formed in at least a portion of one of said pair of opposing side walls, said gusset having a first end aligned with one of said plurality of walls and having a second end extending downward toward a second of said plurality of walls, said gussets being aligned inward of a portion of one of said pair of opposing side walls to form a pocket having an external panel;

c) an aperture formed through said external panel of said pocket and being sized to receive at least one human finger; and d) a line of weakness formed in said side wall containing said external panel with said aperture formed therethrough, said line of weakness having two portions each being located on an opposite side of said aperture with each portion extending from said first end of said gusset to a point spaced apart therefrom, wherein each of said two portions of said line of weakness extend above said aperture formed through said external panel of said pocket, and a third portion of said line of weakness extending across at least a portion of said side wall and connecting with said first two portions of said line of weakness, whereby said gusset, said aperture and said line of weakness create a structure which allows said package to be easily opened.

2. The flexible package of claim 1 wherein said gusset has a triangular configuration with said first end representing a base of a triangle and said second end representing an apex of said triangle.

3. The flexible package of claim 2 wherein said package has a height and said triangularly shaped gusset has a height that extends at least about 20% of said package height.

4. The flexible package of claim 2 wherein said package has a height and said triangularly shaped gusset has a height that extends at least about 30% of said package height.

5. The flexible package of claim 1 wherein each of said line of weakness is a continuous line.

6. The flexible package of claim 1 wherein each of said first two portions of said line of weakness is aligned as a mirror image of one another.

7. The flexible package of claim 1 wherein each of said first two portions of said line of weakness is aligned parallel to one another.

8. The flexible package of claim 1 wherein said package is formed from a polymeric film.

9. A flexible package having an easy opening feature, said package comprising:

a) a front wall, a back wall, a pair of opposing side walls, a top wall and a bottom wall, all of said walls being connected together to form an internal compartment capable of containing at least one row of articles;

b) a gusset formed in at least a portion of one of said pair of opposing side walls, said gusset having a first end aligned approximate said top wall and having a second end extending downward toward said bottom wall, said gusset being aligned inward of a portion of one of said pair of opposing side walls to form a pocket having an internal panel and an external panel;

c) a bottom seal formed in said bottom wall of said package to enclose said articles;

d) at least one aperture formed through said external panel of said pocket and said aperture being sized to receive at least one human finger; and e) a line of weakness formed in said side wall containing said external panel with said aperture formed therethrough, said line of weakness having two portions each being located on an opposite side of said aperture with each portion extending from said first end of said gusset to a point spaced apart therefrom, wherein said first two portions of said line of weakness extend above said aperture formed through said external panel of said pocket, and a third portion of said line of weakness extending across at least a portion of said side wall and connecting with said first two portions of said line of weakness, whereby said gusset, said aperture and said line of weakness create a structure which allows said package to be easily opened.

10. The flexible package of claim 9 wherein said package is void of a handle.

11. The flexible package of claim 9 wherein said third portion of said line of weakness is aligned perpendicular to said other two portions.

12. The flexible package of claim 9 wherein there are two gussets formed in said package, each gusset having an aperture formed through an external panel of said respective pocket, and said line of weakness is formed in each of said side walls to create a structure which allows said package to be easily opened at two different locations.

13. The flexible package of claim 9 wherein said package is formed from polyethylene.

* * * * *